US005257299A

United States Patent [19]

Wilson

[11] Patent Number: 5,257,299

[45] Date of Patent: Oct. 26, 1993

[54] METHOD AND SYSTEM FOR COUNTING IRREGULARLY SHAPED MOVING ARTICLES

[75] Inventor: William J. Wilson, Holland, Pa.

[73] Assignee: The Langston Corporation, Cherry Hill, N.J.

[21] Appl. No.: 896,483

[22] Filed: Jun. 2, 1992

Related U.S. Application Data

[63] Continuation of Ser. No. 710,731, Jun. 4, 1991, abandoned.

[51] Int. Cl.[5] ..... G06M 7/04; G06M 3/02

[52] U.S. Cl. ..... 377/6; 377/24; 377/37; 340/674; 364/471; 250/232 R

[58] Field of Search ..... 377/6, 2, 8, 17, 24, 377/39; 250/223 R; 340/674; 364/471

[56] References Cited

U.S. PATENT DOCUMENTS

| | | | |
|---|---|---|---|
| 4,063,820 | 12/1977 | Borgese | 250/223 R |
| 4,166,246 | 8/1979 | Matt | 328/5 |
| 4,237,378 | 12/1980 | Jones | 250/223 R |
| 4,394,740 | 7/1983 | Shalon | 377/24 |
| 4,484,066 | 11/1984 | Deblieux et al. | 377/6 |
| 4,504,916 | 3/1985 | Oka | 364/471 |
| 4,665,392 | 5/1987 | Koontz | 340/674 |
| 4,805,199 | 2/1989 | Muramatsu | 377/39 |
| 4,881,248 | 11/1989 | Korechika | 377/17 |
| 5,022,059 | 6/1991 | Arai | 377/39 |

FOREIGN PATENT DOCUMENTS 2165042 4/1986 United Kingdom .

*Primary Examiner*—John S. Heyman

*Attorney, Agent, or Firm*—Seidel, Gonda, Lavorgna & Monaco

[57] ABSTRACT

A method and a system for counting irregularly shaped articles that are being moved along a path into and out of a machine. A microprocessor is responsive to three external devices with the first device being located at the input stage of the machine and detecting the leading and the trailing edges of the articles being moved into the machine and respectively generating start and stop events to the microprocessor. The second device is a distance sensing means used to determine the length of each of the articles being moved. The third device detects the movement of the articles in their formed state, such as a box, out of the machine. The microprocessor in response to the first occurring start event initiates the counting of the incremental changes from the distance sensing means and terminates the counting in response to the first occurring stop event. The accumulated count is then decremented by one incremental change so as to serve as a reference length used to compare against each of the subsequent articles. The microprocessor in response to the second occurring start event initiates the counting of the incremental changes from the distance sensing means and counts such until the amount of the incremental changes corresponds to the reference length whereupon the occurrence of the exit signal from the device at the output stage causes the count of the articles to be incremented.

32 Claims, 8 Drawing Sheets

METHOD AND SYSTEM FOR COUNTING IRREGULARLY SHAPED MOVING ARTICLES

This is a continuation of co-pending application(s) Ser. No. 07/710,731 filed on Jun. 04, 1991, now abandoned.

BACKGROUND OF THE INVENTION

The present invention relates to a method and a system to count moving articles and, more particularly, to a method and a system for counting irregularly shaped articles being moved into a machine that performs printing, slotting and cutting operations on such articles to form finished boxes which are also counted as they are being moved out of the machine.

Methods and systems for counting moving articles are known and are described in U.S. Pat. Nos. 4,166,246 (Matt); 4,237,378 (Jones); 4,504,916 (Oka) 4,665,392 (Koontz) and 4,881,248 (Korechika). U.S. Pat. No. 4,166,246 discloses a counting system used in the packaging industry.

In the manufacturing process of packaging boxes, it is common to use an initial blank that has irregularly shaped portions such as flap regions as well as irregularly occurring spaced cutouts in the blanks. Machines using such blanks commonly have a counter/ejector assembly whose operation is dependent on accurate counting. For such assemblies, blank counting is commonly accomplished by a retro-reflective photocell that senses the presence of blanks. Accurate counting by such sensing is made difficult by the presence of dark, black or brown, printed images or cutouts in the blank that may be present in the optical path of the photocell. These images and cutouts cause the photocell to change states several times before the actual blank end, and thus create multiple counts for each blank which, in turn, may be misinterpreted by the counting means.

To combat this misinterpretation, the photocell may be physically moved to an area of the blank, which moves past the photocell, that does not have printing or cutouts. For certain type blanks used in the formation of certain style boxes, it is not always possible to provide such an area. Further, moving the photocell is time consuming and has attendant production losses that may be encountered each time different style boxes are to be formed.

It is an object of the present invention to provide a system that does not suffer the drawbacks of the prior art devices and which accurately counts moving articles, such as irregularly shaped blanks, and different style formed boxes.

It is a further object of the present invention to provide a method which accurately counts the articles in spite of the presence of various dark images as well as cutouts.

Still further, it is an object of the present invention to provide a machine having a counter/ejector assembly that accurately counts both initial irregularly shaped blanks and different style boxes that are formed by the machine.

SUMMARY OF THE INVENTION

The present invention is directed to a method and a system for counting articles that are being moved along a predefined path such as that which occurs in the manufacturing of packaging boxes.

The system comprises a microprocessor responsive to input signals generated by means for detecting leading and trailing edges of the articles being moved into a packaging machine, distance sensing means used to determine the length of the article being moved, and means for counting the formed containers or boxes leaving the packaging machine. The means for detecting the leading or trailing edge is located at the input stage of the machine and respectively generates start and stop event signals that are sent to the microprocessor. The distance sensing means counts incremental changes which are indicative of the movement of the articles into the machine and generates and sends signals representative thereof to the microprocessor. The means for counting is located at the output stage of the machine and generates and sends to the microprocessor an exit event signal for each counted container or box. The microprocessor accommodates a set-up or reference run for the machine and the actual production run of the machine. The microprocessor, in response to the first occurring start event, initiates the counting of the incremental changes from the distance sensing means and terminates the counting in response to the first occurring stop event. The cumulative count is decremented by one incremental change and serves as a set-up or reference length for each of the articles to be subsequently moved into the machine. The microprocessor, in response to the exit event, increments by one the number of containers being counted and then disables the monitoring of the exit event. The microprocessor then initiates the counting of the incremental changes from the distance sensing means and monitors such until the amount of such incremental changes corresponds to the reference length. The microprocessor then re-enables the monitoring of the exit event and the occurrence of such an exit event causes the count stored in the microprocessor of the number of containers being counted to be incremented.

The method of the present invention may be used for counting any moving article and comprises the steps of detecting the leading edge of a first reference article being moved into a machine, and then determining the length of this reference article by counting incremental changes of its movement. The method terminates such counting upon detecting the trailing edge of the reference article being moved into the machine. The cumulated count is then decremented by one incremental change and is then stored as the length of the reference article against which subsequent moving articles are compared. The method then detects the movement of the container or box, formed from the article, at the output stage of the machine, increments the count of the articles being counted, and then disables such counting. The microprocessor then counts the incremental changes from the distance measuring means until the accumulated amount is equal to the count of the reference article, whereby the counter storing the number of articles being counted is re-enabled. The method then waits for the container formed from the first subsequent article to move pass the detecting means in the output stage in the machine. The method continues the above steps, starting at the detection of formed boxes at the output stage, for subsequent articles that are being moved into the machine.

Other objects, advantages and novel features of the present invention will become apparent from the foregoing detailed description of the invention when considered in conjunction with the accompanying drawings.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
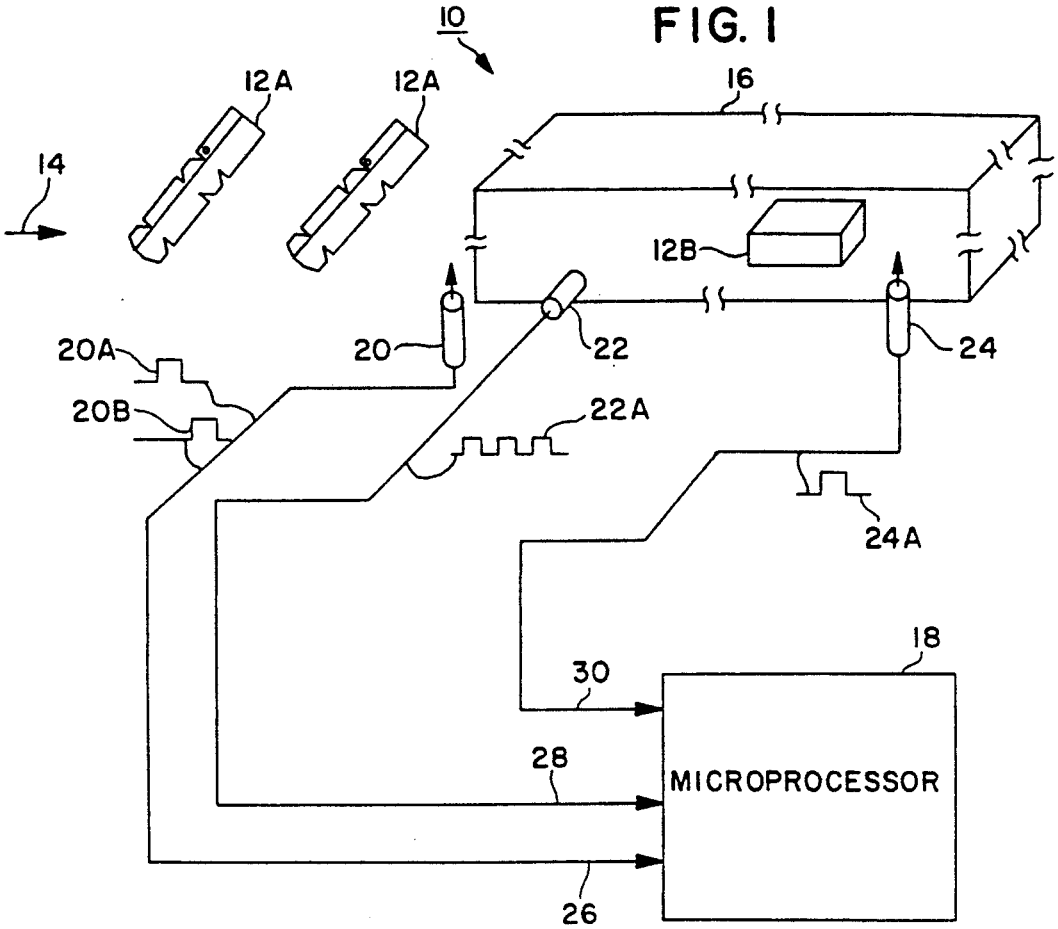
FIG. 1 is a functional representation showing the essential elements of the present invention.
Figure 1A:
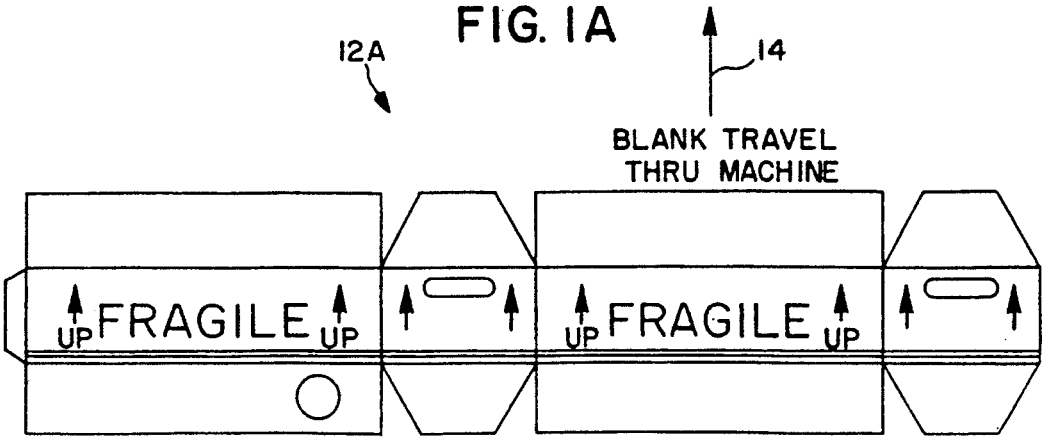
FIG. 1A illustrates a typical box blank associated with the practice of the present invention.

The present invention is directed to a method and a system to accurately count articles that are being moved into and out of a machine. FIG. 1 is a functional representation showing the essential elements of a system 10 of the present invention. The system 10 has various applications, but is particularly suited for counting articles that are being moved along a predetermined path during a manufacturing process such as occurs during the formation of containers or boxes. FIG. 1 shows irregularly shaped blanks 12A having cutouts being moved along a path 14 and being formed into packages o boxes 12B by a machine 16. The layout of a typical printed die cut box blank 12A is shown in FIG. 1A illustrating the printing and die cutting that may cause false counts such as discussed in the "Background" section. The system 10 of FIG. 1 that eliminates such false counts comprises a programmable controller such as a microprocessor 18, detecting means 20, distance sensing means 22, and counting means 24.

The microprocessor 18 stores information, has an internal clock, and is responsive to signals present at its inputs 26, 28 and 30 that are respectively generated by the means 20, 22 and 24.

The detecting means 20 is located at the input stage of the machine 16 and detects the leading and the trailing edges of each of the blanks 12A being moved into the machine 16. The means 20, in response to the detection of the leading and trailing edges of the blanks, respectively, generates start 20A and stop 20B event signals that are routed to the microprocessor 18 by way of input path 26.

The distance sensing means 22 provides information for the microprocessor 18 to determine the length of each of the blanks 12A being moved into the machine 16. The distance sensing means counts incremental changes representative of the movement of the blanks within the machine 16, and generates, in response thereto, electrical signals 22A which are representative of the movement of the blanks. This information is routed to the microprocessor 18 by way of path 28.

The counting means 24 is located at the output stage of the machine 16. The counting means 24 detects the articles 12B, commonly in the form of boxes that have been produced from the initial blanks 12A, being moved out of the machine 16 and generates an exit event signal to the microprocessor 18 by way of input 30.

The microprocessor 18, in response to the first occurring start event, generated by the detecting means 20, initiates the counting of the incremental changes from the distance means 22, and terminates such counting in response to the first occurring stop event of counter 24. The cumulated count is then decremented by one incremental change 22A to ensure, as to be described hereinafter, the proper operation of counter 24. The decremented count serves as a reference length against which each of the subsequent blanks being moved is compared. The microprocessor, in response to first exit event, increments by one the number of boxes being counted and then disables the monitoring of the exit event. The microprocessor then initiates the counting of the incremental changes from the distance sensing means 22. The counting continues until the amount of incremental changes corresponds to the reference length, whereupon the microprocessor then enables the monitoring of the exit event and the occurrence of such an exit event increments the count of the boxes being counted. If desired, the microprocessor 18 may be programmed to ignore the first occurring exit event from the counter 24 so that the box formed from the reference blank is not included in the number of containers being counted.

Figure 2:
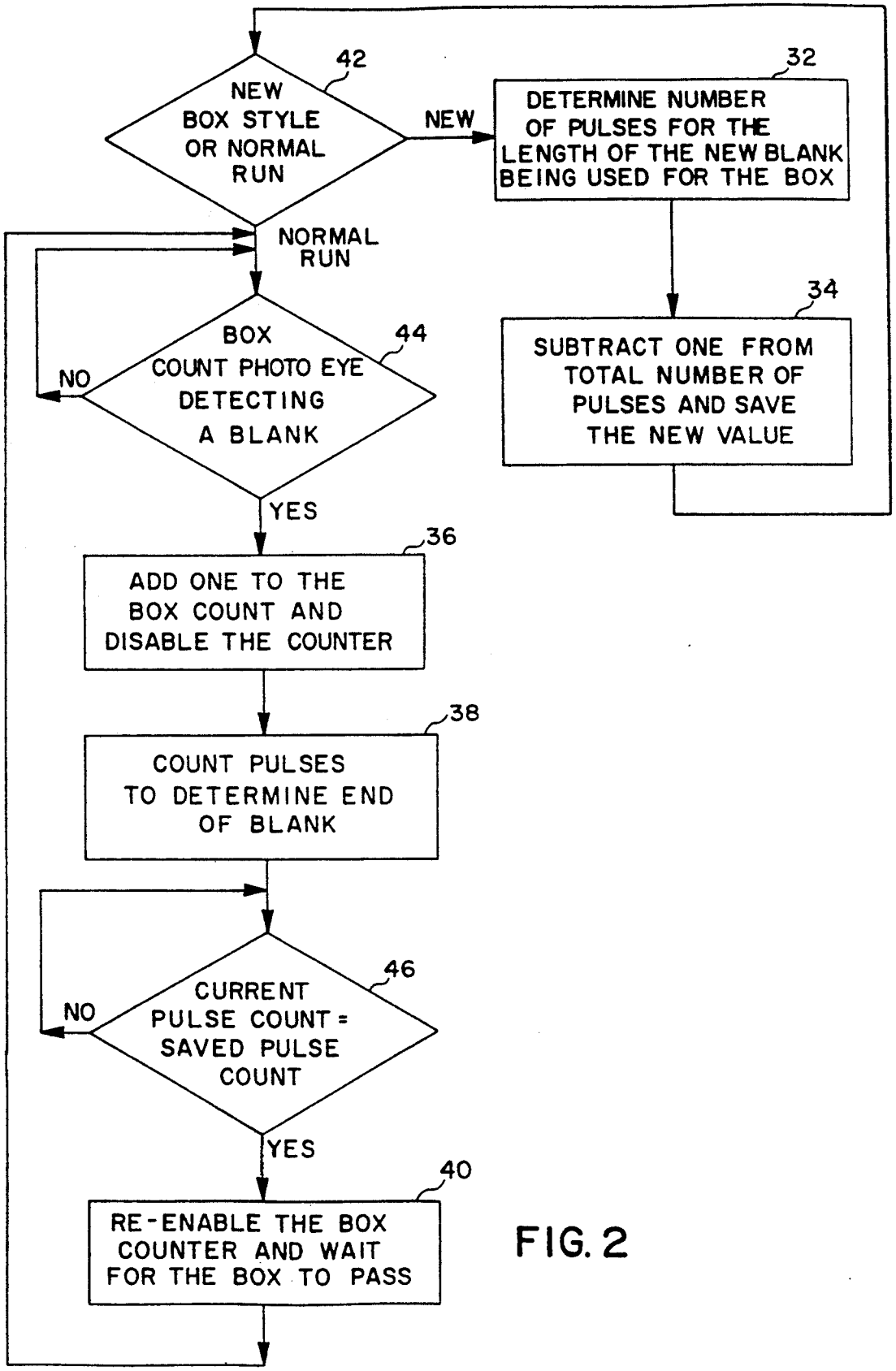
FIG. 2 is a flow chart illustrating a step-by-step progression of one method of the present invention.

The operation of the microprocessor 18 for one embodiment of the present invention related to counting packaging boxes may be further described with reference to FIG. 2. FIG. 2 is a flow chart showing a step-by-step progression of the operation of the microprocessor 18 and comprises processing segments and decision segments, respectively, given in Tables 1 and 2.

TABLE 1

| Processing Segments | Nomenclature |
|---|---|
| 32 | Determine number of pulses for the length of the new blank being used for the box. |
| 34 | Subtract one from total number of pulses and save the new value. |
| 36 | Add one to the box count and disable the counter. |
| 38 | Count pulses to determine end of blank. |
| 40 | Re-enable the box counter and wait for the box to pass. |

TABLE 2

| Decision Segments | Nomenclature |
|---|---|
| 42 | New box style or normal run. |

TABLE 2-continued

| Decision Segments | Nomenclature |
|---|---|
| 44 | Box count photoeye detecting a blank. |
| 46 | Current pulse count = saved pulse count. |

The step-by-step progression shown in the flow chart of FIG. 2 may be divided into a setup run and a normal run, wherein the setup run comprises decision segment 42 and processing segments 32 and 34, whereas the normal run comprises the rest of the decision and processing segments shown in FIG. 2.

In practice, the setup run is used to establish a reference for counting the finished boxes that are to be produced by the machine 16 for each new order or style of box. This reference length is necessary because each new style box may be of a distinct length. For such a setup run, the detector means 20, shown in FIG. 1, detects the leading edge of the reference blank 12A being moved into the machine and generates the start signal 20A to the microprocessor 18. The microprocessor 18 then accomplishes programming segment 32 to determine the length of the reference blank 12A by counting the number of pulses (22A) generated by distance sensing means 22. The pulses 22A are representative of incremental changes in the linear distance that the blank 12A is being moved along its path into the machine 16. The microprocessor 18 continues to count the pulses 22A until detector means 20 senses the trailing edge of the blank 12A and, in response thereto, generates the stop event 20B to the microprocessor 18. The pulses, indicative of linear distance, are representative of the length of the reference blank 12A.

The microprocessor 18, as shown in segment 34, then subtracts or decrements one incremental change representative of one pulse 22A, from its cumulated count and stores such a decremented count as its reference length for blank 12A. This decremented amount is used as the reference length of the blank against which subsequent blanks are to be compared. The subtraction of the one pulse ensures that the counting means 24, at the output stage of machine 16, is enabled near the trailing edge of the formed box, but not after the trailing edge. It is preferred that the count of the blanks being moved into the machine and the count of the boxes being formed by the machine include the reference blank (12A, FIG. 1) and such inclusion is accomplished by the counting means 24 detecting the related box (12B, FIG. 1) formed from the referenced blank. If desired, by appropriate programming of processor 18, the reference blank and related box can be ignored or disregarded from the actual number of blanks and boxes associated with the production run. Once the length to be used for the reference or setup blank is determined (segment 34), the routines of the microprocessor 18 revert to their initial decision (segment 42).

The microprocessor 18 sequences to the normal run, as shown at the output of segment 42, and detects (segment 44) the exit event 24A indicative that the counter 24 detected a formed box. The microprocessor 18, as indicated in segment 36, increments or adds one to the count stored for the number of boxes being counted, and then disables the monitoring of signal 24A of counter 24. The microprocessor 18 then starts counting (segment 38) the representative incremental changes (pulses 22A) of movement which are transmitted by the distance sensing means 20. The microprocessor 18 continues such counting until the number of pulses counted equals the number of pulses corresponding to the length of the reference blank. When such equality is attained, the microprocessor 18 re-enables the monitoring of signal 24A from counting means 24 and waits for the formed box to pass the counter 24. The re-enablement for monitoring of signal 24A and for the waiting for the box to pass are indicated in segment 40 of FIG. 2. The routines of the microprocessor 18 then revert to monitoring the output of segment 42 and wait for the next occurring exit event 24A from means 24. Such an event 24A is indicative of the detection of the next or second box formed by the machine 16. The operation of the microprocessor 18 awaiting such detection is indicated by decision segment 44 of FIG. 2. Upon detection, the step-by-step process is repeated as indicated by the sequential segments 36, 38, 46 and 40 of FIG. 2.

The present invention having the flow chart of FIG. 2 and the functional representation shown in FIG. 1, is particularly suited for a machine 16 that forms packaging from initial blanks that have irregular shapes with spaced cutouts. Such a machine 16 may be further described with reference to FIG. 3 which is a side view showing the machine 16 as having means 20, 22 and 24, previously described with reference to FIGS. 1 and 2, along with the elements given in Table 3.

TABLE 3

| Element | Nomenclature |
|---|---|
| 52 | Feed section |
| 54 | First print section |
| 56 | Second print section |
| 58 | Slotter/creaser section |
| 60 | Die cutter |
| 62 | Folder entrance section |
| 64 | Scrap conveyor |
| 66 | Belt strap conveyor |
| 68 | Folder rails |
| 70 | Folder rail support |
| 72 | Exhaust and fan assembly |
| 74 | Folder exit frame |
| 76 | Counter-ejector |
| 78 | Lower conveyor |
| 80 | Wireway |

Figure 3:
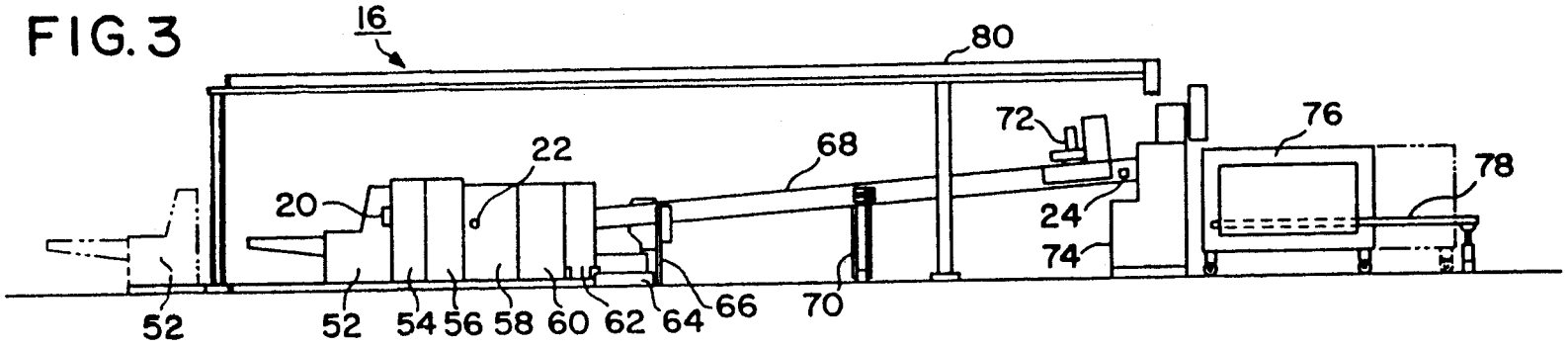
FIG. 3 is a side view of a machine for forming boxes or packages related to the present invention.

The feed section 52 routes and directs the blank 12A, not shown in FIG. 3 but representatively described with reference to FIG. 1, into the machine 16 wherein printing, slotting/creasing and die cutting operations are performed by sections 54–56, 58, and 60, respectively. Machine 16 is further illustrated in FIG. 4 which is a top view showing further elements that are given in Table 4.

TABLE 4

| Element | Nomenclature |
|---|---|
| 82 | Console |
| 84 | DC drive unit |
| 86 | Isolation transformer |
| 88 | AC load center |
| 90 | L.M.C. load center |
| 92 | First print section register |
| 94 | Second print section register |
| 96 | Slotter/creaser section first register |
| 98 | Slotter/creaser section second register |
| 100 | Die cutter register |
| 102 | Upper exit frame assembly |

The machine 16 has the detecting means 20, previously described with reference to FIGS. 1 and 2, located at its input stage and which may be further described with reference to FIG. 5 which is a view taken along line 5—5 of FIG. 4. FIG. 5 shows the detecting means 20 positioned so as to cooperate with a reflector 104, both located at the input stage 106 of the first printer section 52. The detector 20 produces a light beam 108, having a centerline 108A, which is disturbed or interrupted by blank 12A (not shown) moving along a path 110. The movement of blank 12A is accomplished by a plurality of rollers within the machine 16 and which are given, along with other elements, in Table 5.

TABLE 5

| Element | Nomenclature |
|---|---|
| 112 | Lower feed roll |
| 114 | Upper feed roll |
| 116 | Gripping members of roller 114 |
| 118 | Print cylinder |
| 120 | Die blanket of cylinder 118 |
| 122 | Impression roll |
| 124 | Gate bar |
| 126 | Support frame for reflector 104 |
| 128 | Base support for means 20 |
| 130 | Arm support for means 20 |
| 132 | Blank support means |
| 134 | Gate bar channel |
| 136 | Gate bar member |
| 138 | Gate bar support member |

Figure 5:
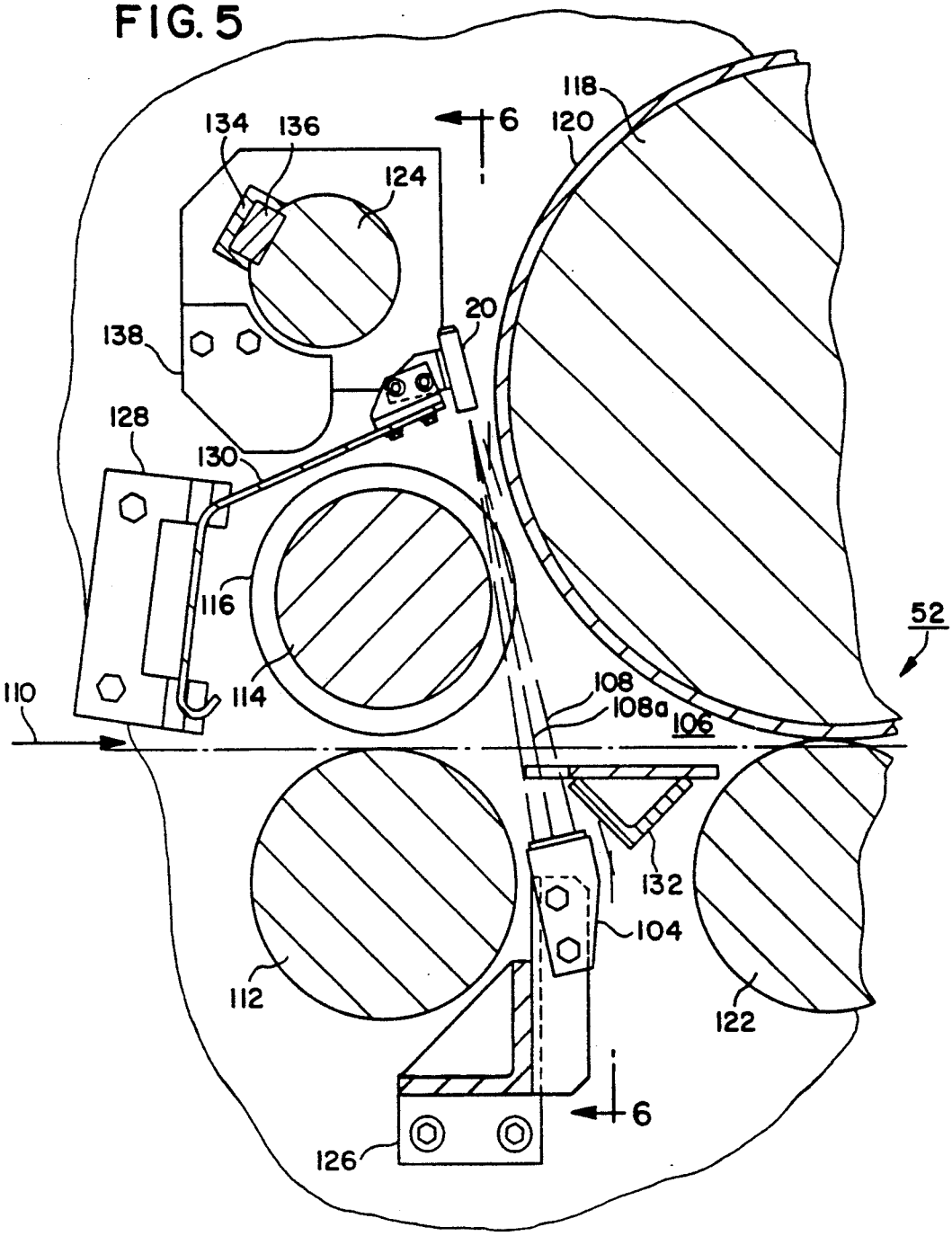
FIG. 5 is a view taken along line 5—5 of FIG. 4, showing the detecting means located at the input stage of the machine.
Figure 6:
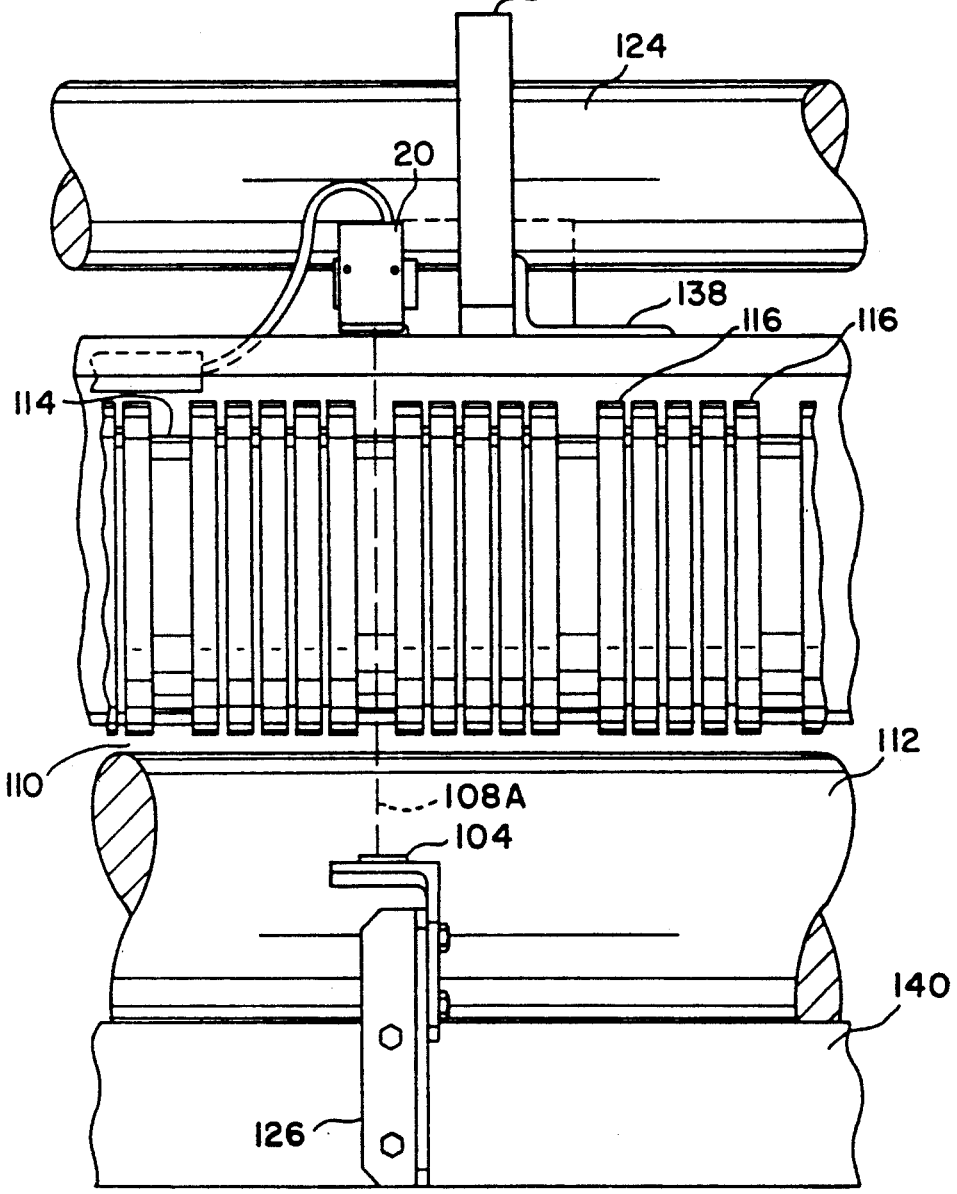
FIG. 6 is a view, taken along line 6—6 of FIG. 5, showing further details of the means for detecting the moving article.

The vertical alignment between the detecting means 20 and the reflector 104 of FIG. 5 may be further described with reference to FIG. 6 which is a view taken along line 6—6 of FIG. 5. Such a view also shows additional details of the arrangement of the gate bar 124 and the upper feed roll 114 as well as the lower feed roll 112 that is positioned behind a vertical cross tie member 140. FIG. 6 is meant to primarily illustrates a vertical arrangement in which the centerline of the detecting means 20 is approximately aligned to the centerline of reflector 104 so that the centerline (108A) of the beam 108 is substantially coaxial with both detecting means 20 and reflector 104.

In operation, and in a manner as discussed with reference to FIGS. 1 and 2, when a blank 12A (not shown in either FIGS. 5 or 6) is being moved along path 110 (FIGS. 5 and 6) and then passes under beam 108, the leading edge of the blank 12A breaks the optical path of beam 108. This breakage or disturbance is detected by detecting means 20 which, in turn, transmits signal 20A, which is an essential feature of the present invention, to the microprocessor 18. Another essential element of the present invention is distance sensing means 22 that cooperates with both detecting means 20 and microprocessor 18, and is shown in FIG. 7 which is a view taken along the line 7—7 of FIG. 4.

Figure 7:
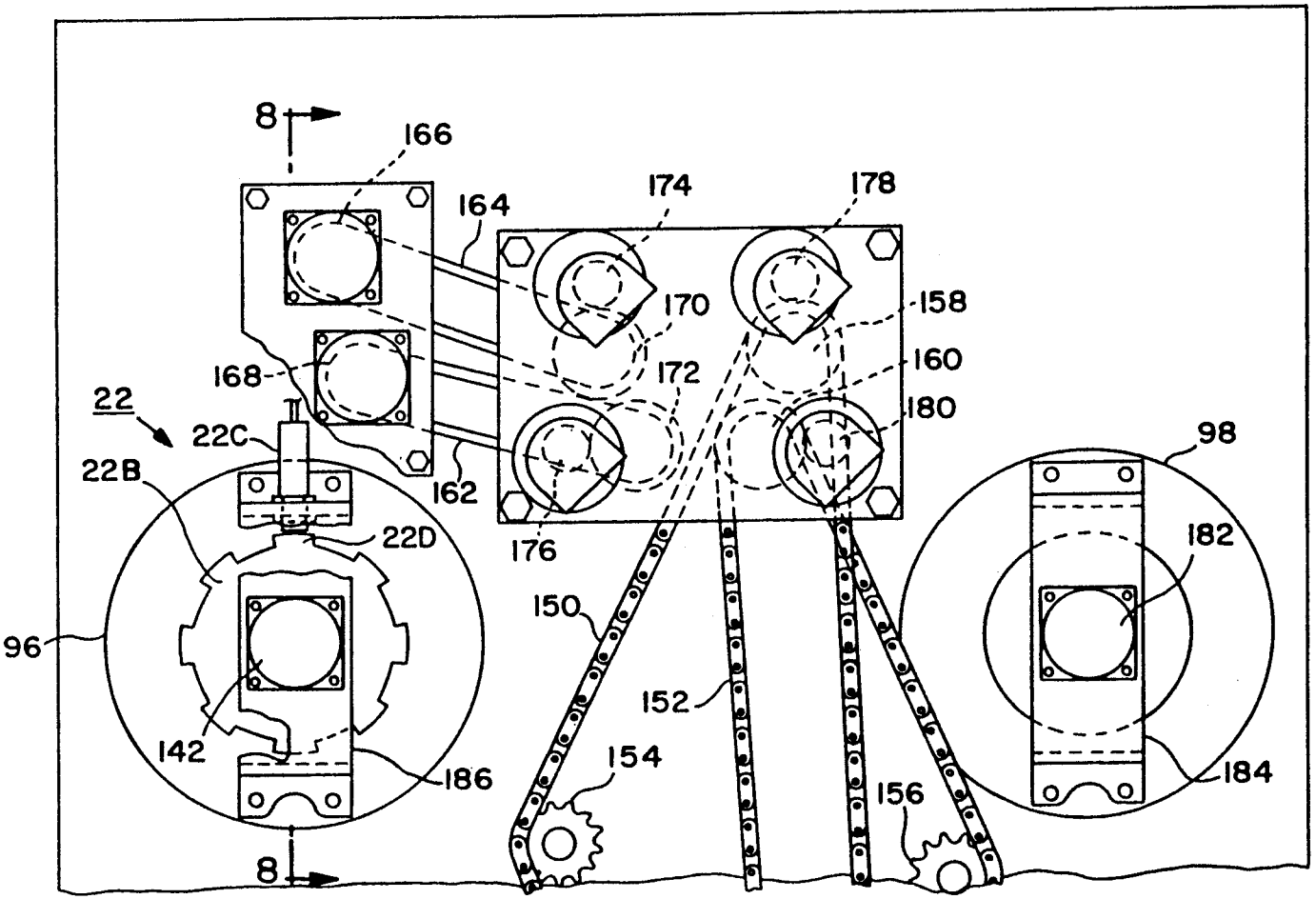
FIG. 7 is a view, taken along line 7—7 of FIG. 4, showing the distance sensing means related to the present invention.

FIG. 7 shows the distance sensing means 22 that generates electric pulses (22A of FIG. 1) which are proportionate in number to the degree of rotation of the upper slotter shaft 142 which, in turn, is indicative of the linear distance that the blank 12A is being moved within the machine 16. The distance sensing means 22 comprises the pulse wheel 22B, connected to a slotter shaft 142, and a pulse counter 22C shown as being positioned in registration with one raised member 22D on pulse wheel 22B. Each time the counter 22C and member 22D are in alignment, a pulse 22A is generated. Because the members 22 are spaced at predetermined angular intervals from each other about wheel 22B, the repetitive alignment of 22C and 22D is indicative of the angular rotation of wheel 22B which, in turn, is indicative of the angular rotation of shaft 142. The pulse counter 22C of FIG. 7 translates the angular rotation of the rotating shaft 142 into a corresponding series of digital pulses 22A. The pulses 22A are representative of the linear distance that the blank 12A is being moved within machine 16. FIG. 7 further shows a plurality of elements related to the drive mechanism of machine 16 and which are given in Table 6.

TABLE 6

| Element | Nomenclature |
|---|---|
| 150 | Drive chain |
| 152 | Drive chain |
| 154 | Chain sprocket |
| 156 | Chain sprocket |
| 158 | Chain sprocket |
| 160 | Chain sprocket |
| 162 | Drive belt |
| 164 | Drive belt |
| 166 | Drive pulley |
| 168 | Drive pulley |
| 170 | Drive pulley |
| 172 | Drive pulley |
| 174 | Motor mount device with lubricant and adjustment means |
| 176 | Motor mount device with lubricant and adjustment means |
| 178 | Motor mount device with lubricant and adjustment means |
| 180 | Motor mount device with lubricant and adjustment means |
| 182 | Leading (with respect to shaft 142) slotter shaft |
| 184 | Brace support |
| 186 | Brace support |

Figure 8:
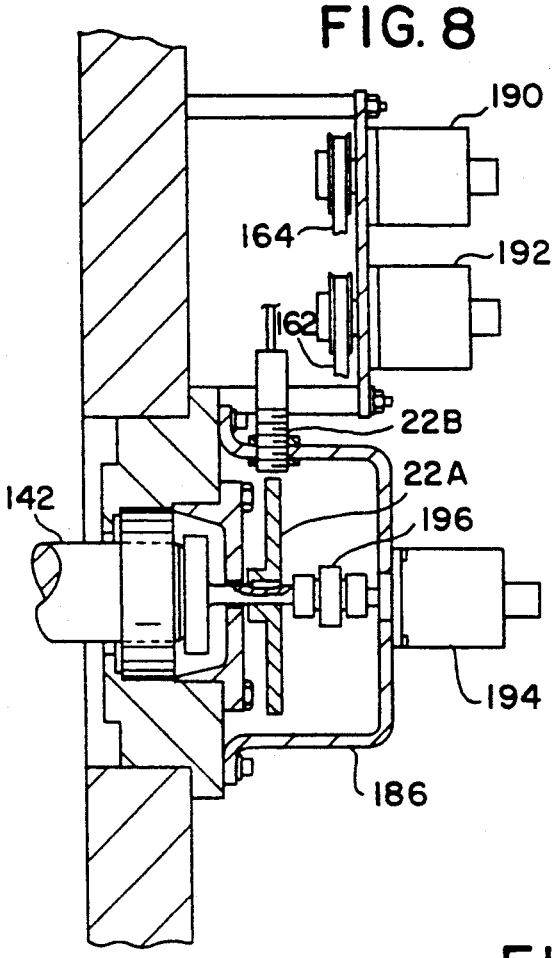
FIG. 8 is a view, taken along line 8—8 of FIG. 7, showing further details of a distance sensing means.

Further details of the distance sensing means 22 may be discussed with reference to FIG. 8, which is a view, taken along line 8—8 of FIG. 7. FIG. 8 further shows the interconnection between the pulse wheel 22A and the slotter shaft 142. FIG. 8 also further illustrates elements which are given in Table 7.

TABLE 7

| Element | Nomenclature |
|---|---|
| 190 | Shaft encoder of belt 164 |
| 192 | Shaft encoder of belt 162 |
| 194 | Shaft encoder interconnected to shaft 142 |
| 196 | Shaft coupler of encoder 194 |

Figure 4:
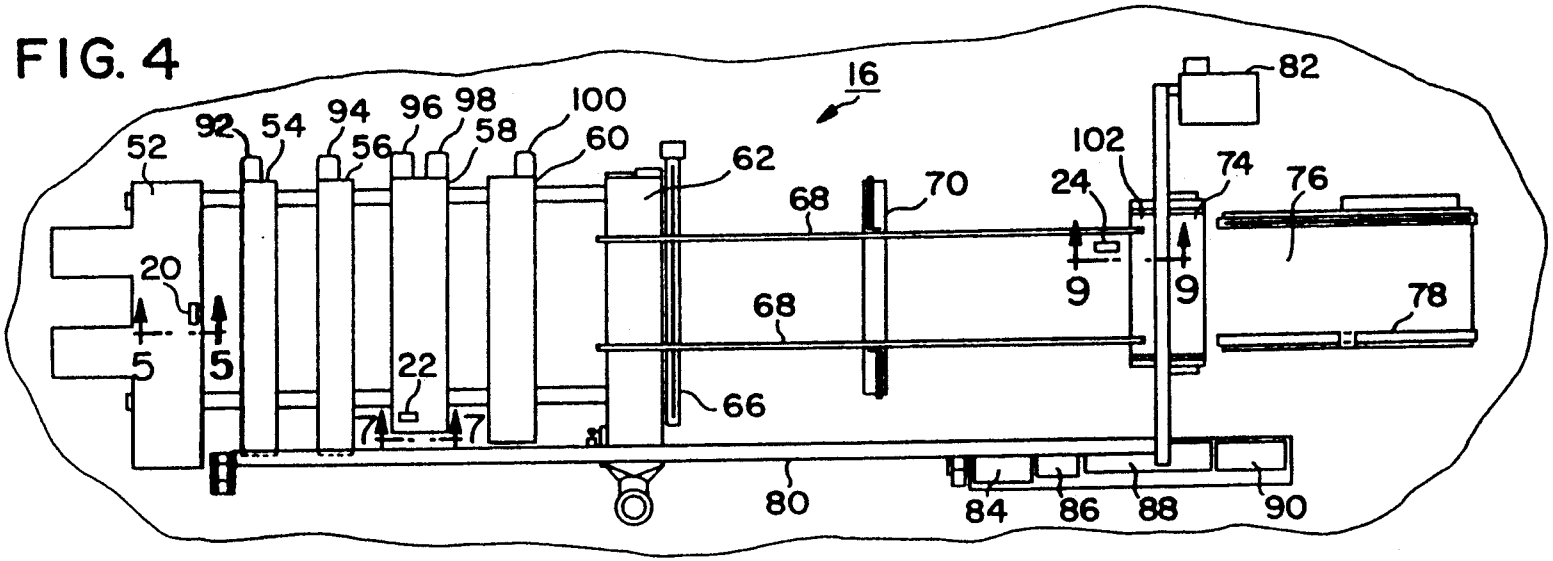
FIG. 4 is a top view of the box forming machine of FIG. 3.
Figure 9:
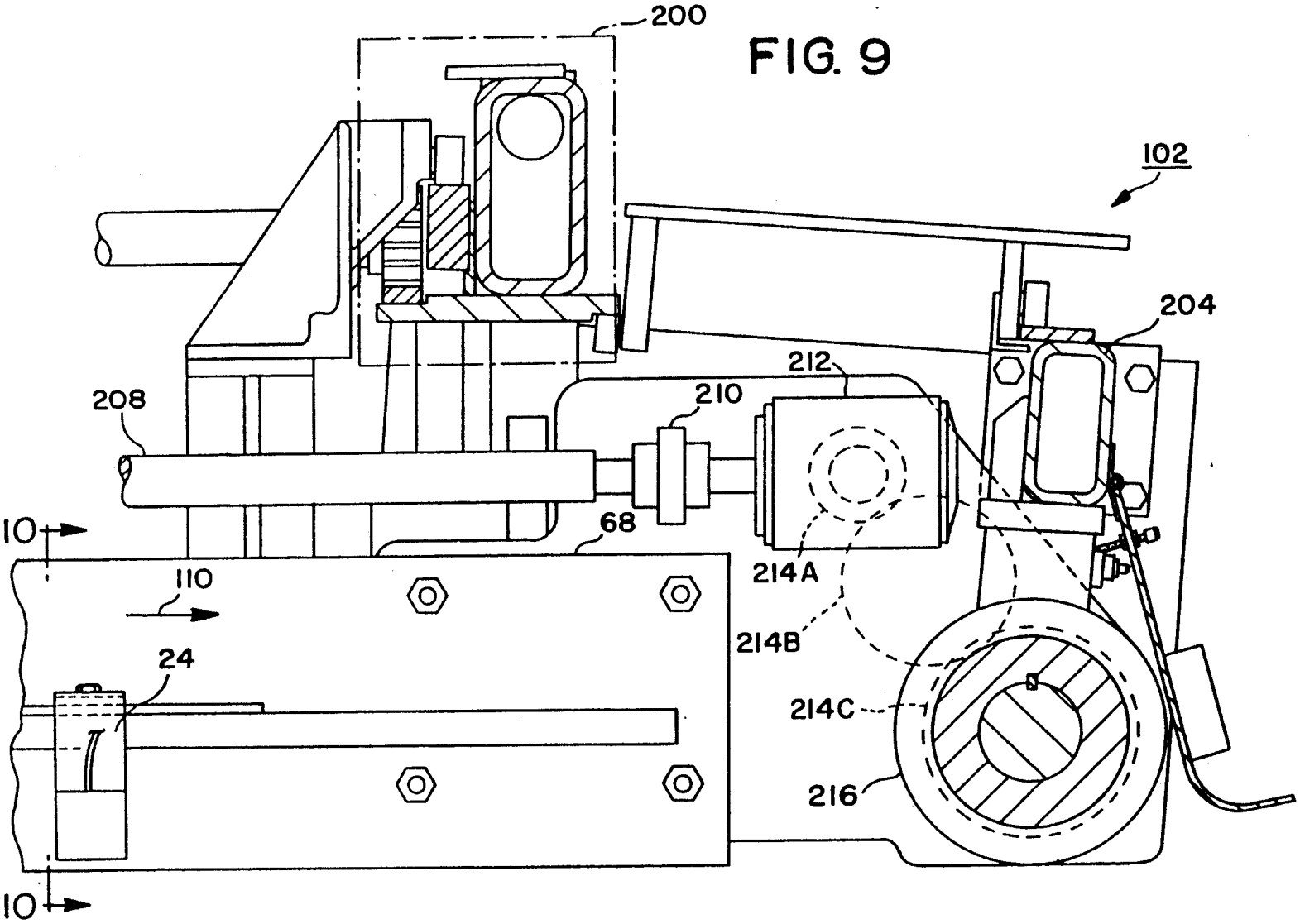
FIG. 9 is a view, taken along line 9—9 of FIG. 4, showing the counting means located at the output stage of the machine.

The counting means 24, which cooperates with the distance sensing means 22 of FIGS. 7 and 8, is shown in FIG. 9 which is a view along ling 9—9 of FIG. 4. FIG. 9 shows the counter 24 as located near the upper exit frame assembly 102. The upper exit frame assembly 102 has mounted thereon means 200 for adjusting the width that is related to the sizes of the blanks and boxes being processed by the machine 16. FIG. 9 further shows a support member 204. The operation of the elements given in Table 8, allows the finished box moving along path 110 to be transferred or passes from the folder exit frame 74 to the counter-ejector assembly 76 both shown in FIG. 4.

TABLE 8

| Element | Nomenclature |
|---|---|
| 208 | Drive shaft |
| 210 | Shaft coupler |
| 212 | Drive gear box |
| 214A | Drive gear |
| 214B | Idler gear |
| 214C | Driven gear |

TABLE 8-continued

| Element | Nomenclature |
|---|---|
| 216 | Driver roller |

In operation, when the box 12B, discussed with reference to FIGS. 1 and 2, has moved past the counter means 24, the box passed onto the counter-ejector assembly 76 of FIG. 4.

Figure 10:
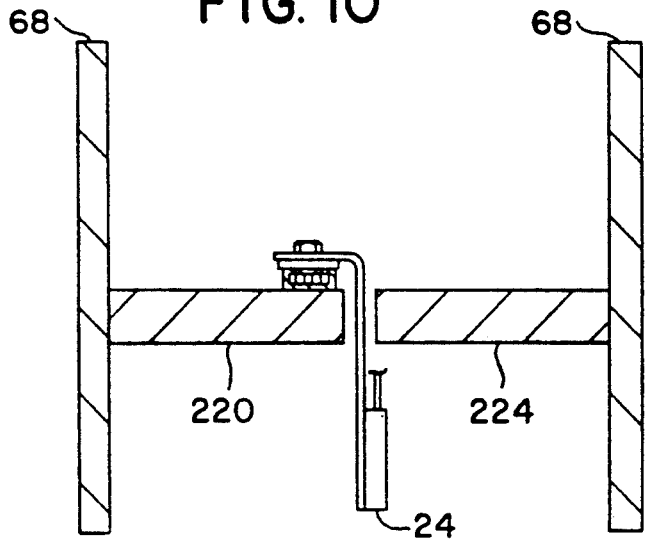
FIG. 10 is a view, taken along line 10—10 of FIG. 9, showing the orientation of the counting means at the output stage of the machine.

The counting means 24 is further illustrated in FIG. 10 which is a view taken along the line 10—10 of FIG. 9. FIG. 10 shows the counter 24 as being positioned between members 220 and 222 and supported by member 220. The counting means 24 is positioned near the folder exit frame 74 (see FIG. 4) and mounted between the folder rails 68 (see FIG. 10). The counting means 24 counts the finished boxes 12B being moved into the folder exit frame 74 and toward their final destination, the counter ejector 76 of machine 16.

It should now be appreciated that the present invention provides means for accurately counting blanks that are formed into finished packages by the machine 16. The machine 16 shown in FIGS. 3 and 4 may be a flexofolder gluer having a counter ejector mechanism. For such a machine, without the benefits of the present invention, the blank counting is typically accomplished using a retroreflective photocell, such as detector means 20, whereby the blank is counted when the blank enters the photocell area (see FIG. 5) and its presence is detected. This detection is necessary for the subsequent timing of the counter-ejector mechanism.

As discussed in the "Background" section, the blank, such as that shown in FIG. 1A, to be counted typically may have dark printed images, such as of a black or brown color, and die cutouts, all of which may be in the path of the photocell. Typically, and without the benefits of the present invention, these dark printed images and cutouts commonly cause the photocell 20 to change state several times before the actual blank ends, thus giving multiple counts for the same blank which, in turn, may be misinterpreted by the counter-ejector mechanism. To avoid this problem, prior art techniques physically move the photocell so that its beam, such as 108 discussed with regard to FIGS. 5 and 6, only intercepts the area of the blank that does not have any dark printed images or cutouts. This physical movement causes attendant productivity losses. Further, for certain types or styles of box to be produced by machine 16, it may prove impossible to position the photocell in such a manner so as to avoid these dark printed images or cutouts.

The present invention, using the microprocessor techniques described hereinbefore, eliminates the counting problem commonly caused by the different images and cutouts. The microprocessor of the present invention responds to the detection of the leading edge of the blank. Such detection is dependent only on the first interruption in the beam pattern, and thus avoids the problems created by different images or cutouts of the blank. The length of the blank is already known because the automatic setup, previously described, so that the counter 24 at the output stage of machine can be unblocked prior to the trailing edge which is located in the trailing flip region of the formed box. The trailing flap region does not have any significant printing or die cutouts so that the multiple counts are not encountered.

It should now be appreciated that microprocessor 18 in response to a single event 20A, corresponding to the leading edge of blank entering into the input stage, operates in a sequential manner to accurately count the blank and boxes related to the machine 16 having a counterejector assembly. Although the microprocessor 18 is the preferred device, other devices may be used for the practice of this invention. For example, the microprocessor may be replaced by means for storing information, such as registers, that are responsive to the first start signal 20A for initiating counting of pulse signal 22A and terminating such counting, in a manner as previously described, in response to the stop 20B and exit 24A events.

In addition to accurate counting, the present invention provides a means to avoid jamming conditions related to the blanks 12A moved into a machine 16. Such avoidance is accomplished by having the microprocessor monitor the length of time that the blank 12A is within the input stage 106 of the machine. If the blank 12A remains within this input stage for an excessive amount of time, the microprocessor senses a jam and correspondingly initiates corrective actions to have the jammed blanks 12A removed.

The present invention may be embodied in other specific forms without departing from the spirit or essential attributes thereof and, accordingly, reference should be made to the appended claims, rather than to the foregoing specification, as indicating the scope of the invention.

I claim:

1. In a machine for forming a box from a blank having a system for counting blanks being moved into the machine and for counting formed boxes being moved out of the machine, said counting system comprising:

(a) a microprocessor responsive to input signals;

(b) detecting means, located at the input stage of said machine, for detecting the leading and the trailing edges of each of said blanks being moved into said machine and generating respective start and stop events that are applied to said microprocessor as input signals;

(c) distance sensing means for generating pulses each representative of an incremental change in the linear distance that said blanks are being moved, such pulses being applied to said microprocessor as input signals; and (d) counting means, located at the output stage of said machine, for detecting the boxes formed from said blanks and which are being moved out of said machine, said counting means generating an exit event for each such detected box;

whereby said microprocessor, in response to the first start event, initiates the first counting of the incremental changes of movement and terminates such counting in response to the first occurring stop event, said accumulated count being decremented by at least one incremental change of movement and which decremental count serves as a reference length for comparing against subsequent blanks, said microprocessor in response to the first exit event incrementing by one the counting of the formed boxes and then disabling the monitoring of such exit event, said microprocessor then initiating the counting of the incremental changes of movement signals until the amount of such second occurring incremental changes corresponds to the said reference length, whereupon the microprocessor enables the monitoring of said exit event, said microprocessor in, response to each subsequent exit event, incrementing its count of formed boxes and initiating its counting of said incremental changes.

2. A machine according to claim 1, wherein said microprocessor ignores the first occurring exit event in its incrementing of its counting of formed boxes.

3. The system according to claim 1, wherein said detecting means comprises a photocell having a light source for illuminating blanks that pass in close proximity thereto.

4. The system according to claim 3, wherein said photocell is vertically oriented with respect to each passing blank.

5. A machine according to claim 1, wherein said distance sensing means comprises:

(a) a pulse wheel interconnected to a shaft whose movement is proportionate to the linear distance that the blanks are being moved; and (b) a pulse counter that generates electrical pulses representative of the degree of rotation of said pulse wheel.

6. A machine according to claim 1, wherein said counting means is vertically oriented with respect to the boxes being moved out of said machine.

7. A machine according to claim 1, wherein said articles are passed out of said machine by means of a drive mechanism.

8. A machine according to claim 1, wherein said microprocessor further comprises means for detecting the presence of said blanks within said input stage for a predetermined time.

9. A method for counting blanks being moved into a machine and counting boxes formed from such blanks which are being moved out of the machine, said method comprising the steps of:

(a) providing means at the input stage of a machine for detecting the leading edge of a blank;

(b) detecting the leading edge of a reference blank moving into said input stage;

(c) determining the length of said reference blank by counting incremental changes representative of the linear distance of the movement of said blank within said machine;

(d) subtracting one of said incremental changes from said determined length and storing said reduced length as the new length of said reference blank;

(e) detecting said reference blank after it has been formed into a finished box, at the output stage of said machine;

(f) incrementing the count of the number of boxes being counted;

(g) disabling said counter storing said number of boxes being counted;

(h) counting said incremental changes of said movement of said subsequent blank until the count corresponding to said new length of said reference blank;

(i) re-enabling said counter storing said number of counted boxes;

(j) waiting for said finished box to pass said detecting in said output stage;

(k) detecting said subsequent blank after it has been formed into a finished box, at the output stage of said machine;

(l) incrementing said counter storing said number of boxes being counted; and (m) repeating steps (g)-(l) for each of said remaining subsequent boxes being moved out of said output stage of said machine.

10. A system for counting articles being moved along a path into and out of a machine comprising:

(a) storage means for control and storing information in response to input signals;

(b) detecting means, located at the input stage of said machine, for detecting the leading and trailing edges of each of said articles being moved into said machine and generating in response thereto respective start and stop events to said storage device;

(c) distance sensing means for generating pulses each representative of an incremental change in the linear distance that said articles are being moved, said pulses being applied to said storage means; and (d) counting means, located at the output stage of said machine, for detecting the articles being moved out of said machine, said counting means generating an exit event for each such detected article;

whereby said storage means, in response to said first occurring start event, initiates the counting of said incremental changes from said distance measuring means and terminates said counting in response to the first occurring stop event, said cumulated count being decremented by one incremental change so as to serve as a reference length for each of said articles, said storage device in response to the first exit event incrementing by one the counting of the articles being formed by said machine and then disabling the monitoring of said exit event, said storage device initiating the counting of said incremental changes from said distance measuring means until the amount of incremental changes corresponds to said reference length, whereupon the storage means enables the monitoring of said exit event, said storage means, in response to each subsequent exit event, incrementing its count of formed articles and initiating its counting of said incremental changes.

11. A system according to claim 10, wherein said storage means ignores the first occurring exit signal in its incrementing of its counting of formed articles.

12. A method of counting articles being moved along a path into and out of a machine comprising the steps of:

(a) detecting the leading edge of a first of said moving articles and generating in response thereto a first start event;

(b) counting preselected increments of travel of such moving article in response to said first start event;

(c) detecting the trailing edge of said first moving article and generating in response thereto a first stop event which, in turn, terminates said counting at a count representative of the length of said first articles;

(d) decrementing said count of said length by one of said preselected increments with said decremented count now serving as the reference length for all of said moving articles;

(e) detecting the leading edge of a second of said moving articles and generating in response thereto a second start event;

(f) counting said preselected increments of travel of said second article in response to said start count until said count is representative of the reference length for all of said articles moving in said machine; and (g) incrementing the count of such moving articles moving into said machine.

13. A method of counting articles moving past an input stage in a machine and moving past an output stage of said machine, said method comprising the steps of:

(a) detecting the leading edge of a reference article being fed into a machine;
(b) generating pulses representative of the length of said reference blank;
(c) storing said pulses in a first pulse counter;
(d) decrementing the count stored in said first pulse counter by one pulse and have such decremental count serve as a reference length for all of said articles;
(e) detecting the article to be counted at the output stage of said machine;
(f) incrementing by one a storage counter storing the count of articles to be counted;
(g) blocking said storage counter after said incrementing;
(h) generating pulses representative of the length of said article being counted and storing said pulses in a second pulse counter;
(i) comparing the contents of said second pulse counter against the contents of said first pulse counter and when equal, re-enabling said storage counter and resetting the first and second pulse counters.
(j) repeating steps (e)–(i) for each article to be counted.

14. A method of counting articles being moved into and out of a machine comprising the steps of:

(a) detecting the leading edge of a reference article being moved into said machine;
(b) determining the length of said reference article by counting increments of movement of said article within said machine and continuing such counting until the detection of the trailing edge of said reference article;
(c) subtracting one of said increments from said determined length and storing said length as a reference length for all of said articles;
(d) detecting said reference article at the output stage of said machine;
(e) incrementing a counter storing the number of articles being counted;
(f) disabling said counter storing said number;
(g) counting said increments of movement of said article until the length of said first article is equal to said reference length of all of said articles;
(h) re-enabling said counter storing said number of articles being counted; and
(i) repeating steps (d)–(h) for each of the remaining articles being moved into and out of said machine.

15. A method of detecting, at a predetermined point along a travel path of a series of variously printed or shaped articles, the arrival of the leading edge of each article at the said point, in which the presence of the article at the said point is detected by detecting means producing an output signal which initiates an action, characterized in that the distance between the leading and trailing edges of the first article of a given type, serving as a reference distance for further such articles, is measured along the said path by detecting the interval between movement along said path of the actual leading and trailing edges of the said first article, and then disabling the output signal or the action initiated thereby, for each succeeding article, from the time when the detecting means detects the leading edge of each succeeding article, until the article has moved through a distance along the said path substantially corresponding to the said reference distance.

16. Apparatus for detecting, at a predetermined point along a travel path of a series of variously printed or shaped articles, the arrival of the leading edge of each article at the said point, including principal detecting means for detecting the arrival at the said point of an article leading edge and for producing an output signal in response thereto, said principal detecting means being incapable of distinguishing between an actual leading edge of an article and an apparent leading edge such as that formed by a slot in the article; and measuring means measuring the distance between the actual leading and trailing edges of the first article of a given type to thus establish a reference distance for such articles, said measuring means comprising preliminary detecting means responsive to the arrival adjacent to it of the actual leading and trailing edges of the said first article and for disabling the output signal of the principal detecting means, or an action resulting therefrom, from the time when the principal detecting means detects the leading edge of each succeeding article and until the article has moved through the said reference distance.

17. A method of counting variously shaped or printed box blanks and similar articles, in which each article is counted, as it moves along a set conveyance path, by a photocell or equivalent detector either serving as a count detector which is sensitive to print on the articles, characterized in that the distance between the leading and trailing edges of the first article of a given type is measured along the path extending past the count detector, thus establishing a reference distance for further such articles, and in which the counter is disabled from the time when the count detector responds to the leading edge of each succeeding article, thus being prevented from incrementing the count, until the article has moved through substantially the said reference distance.

18. A method according to claim 17, in which the said distance is represented by a count of regular pulses generated as the articles move along their conveyance path.

19. A method according to claim 18, in which the time during which the count detector is disable for each article corresponds to the pulse count generated by the first article reduced by one or by another set number, so that the counter becomes active shortly before the trailing edge of each article reaches the count detector.

20. A method according to claim 17, in which the said distance is measured by means of a detector comprising means for directing a beam, especially of light, toward a reflector or beam detector, which beam is interrupted while the first article lies in its path.

21. A method according to claim 18, in which the said distance is measured by means of a detector comprising means for directing a beam, especially of light, toward a reflector or beam detector, which beam is interrupted while the first article lies in its path.

22. A method according to claim 19, in which the said distance is measured by means of a detector comprising means for directing a beam, especially of light, toward a reflector or beam detector, which beam is interrupted while the first article lies in its path.

23. Apparatus for counting variously shaped or printed box blanks and similar articles each having leading and trailing edges separated from each other by a predetermined distance, said apparatus comprising a photocell or equivalent detector for counting the articles as they move along a set conveyance path, which detector serving as a counter detector is sensitive to print on the articles, characterized in that the apparatus includes means for measuring the distance between the leading and trailing edges of the first article of a given type to be conveyed through the counting apparatus, thus establishing a reference distance for further such articles, and the counter is disabled from the time when the count detector responds to the leading edge of each succeeding blank, thus being prevented from incrementing the count, until the article has moved through substantially the said reference distance.

24. Apparatus according to claim 23, in which the said distance is measured by a pulse counter arranged to count regular pulses generated as the articles move along the set conveyance path.

25. Apparatus according to claim 24, in which the pulse counter comprises a pulse wheel driven at a speed proportional to the speed at which the articles are conveyed.

26. Apparatus according to claim 24, in which a count processor is arranged to reduce by one or by another set number the total pulse count during which the article counter is disabled, so that the article counter becomes active shortly before the trailing edge of each article reaches the count detector.

27. Apparatus according to claim 25, in which a count processor is arranged to reduce by one or by another set number the total pulse count during which the article counter is disabled, so that the article counter becomes active shortly before the trailing edge of each article reaches the count detector.

28. Apparatus according to claim 23, in which the means for measuring the said distance comprises a light source arranged to direct a beam, especially of light, toward a reflector or beam detector, which beam is interrupted while the first article lies in its path.

29. Apparatus according to claim 24, in which the means for measuring the said distance comprises a light source arranged to direct a beam, especially of light, toward a reflector or beam detector, which beam is interrupted while the first article lies in its path.

30. Apparatus according to claim 25, in which the means for measuring the said distance comprises a light source arranged to direct a beam, especially of light, toward a reflector or beam detector, which beam is interrupted while the first article lies in its path.

31. Apparatus according to claim 26, in which the means for measuring the said distance comprises a light source arranged to direct a beam, especially of light, toward a reflector or beam detector, which beam is interrupted while the first article lies in its path.

32. Apparatus according to claim 27, in which the means for measuring the said distance comprises a light source arranged to direct a beam, especially of light, toward a reflector or beam detector, which beam is interrupted while the first article lies in its path.

* * * * *